United States Patent [19]

Heald et al.

[11] Patent Number: 4,651,543

[45] Date of Patent: Mar. 24, 1987

[54] LOCK AND PROTECTIVE COVER ASSEMBLY

[76] Inventors: Charles J. Heald, 333 S. School St.; Stanley V. Steele, 204 Crocker (rear), both of Big Pine, Calif. 93513

[21] Appl. No.: 721,427

[22] Filed: Apr. 9, 1985

[51] Int. Cl.[4] ..... E05B 67/38

[52] U.S. Cl. ..... 70/54; 70/455

[58] Field of Search ..... 70/54, 55, 56, 455, 70/454, 423; 150/900

[56] References Cited

U.S. PATENT DOCUMENTS

| | | | |
|---|---|---|---|
| Re. 24,166 | 6/1956 | Stiller | 150/900 |
| 1,662,612 | 3/1928 | Junkune | 70/55 |
| 2,125,354 | 8/1938 | Meier | 150/900 |
| 4,134,280 | 1/1979 | Pelavin | 70/55 |
| 4,224,813 | 9/1980 | Hampton | 70/55 |
| 4,317,344 | 3/1982 | Barnard | 70/55 |

*Primary Examiner*—Robert L. Wolfe
*Attorney, Agent, or Firm*—John J. Posta, Jr.

[57] ABSTRACT

The assembly includes a lock with top hasp and botton keyhole and a flexible, resilient, stretchable covering forming a protective closed casing around the main body of the lock and up through which the hasp protrudes. The casing extends below the lock body and includes a bottom normally closed slit automatically openable by squeezing opposed sides of the lower portion of the casing toward each other at opposite ends of the slit, in order to permit a key to be inserted in the keyhole. The area around the slit can have diverging moisture diverting lips or a single protective overlying lip. Dessicant may be disposed in containers in the casing and the top of the casing can have upstanding collars which tightly grip the hasp. A slot covered with a flap may extend therebetween for removal of the lock from the casing. The casing can be made from natural or synthetic elastomer such as polyurethane capable of retaining its flexibility over a wide temperature range. The assembly is simple and inexpensive and the lock is kept in good working order under all weather conditions.

17 Claims, 15 Drawing Figures

LOCK AND PROTECTIVE COVER ASSEMBLY

BACKGROUND OF THE INVENTION

1. Field of the Invention

The present invention generally relates to locks and, more particularly, to an improved lock and protective cover assembly.

2. Prior Art

A number of covers have been devised to protect locks against the elements. For the most part, such covers have been made of non-corrodable metal, such as aluminum or magnesium, or of relatively stiff and inflexible plastic to seal off the locks from moisture, dirt, rusting and the like. Such covers are normally comprised of two or more hinged or snapped together pieces. See, for example, U.S. Pat. No. 4,317,344 wherein there are disclosed a pair of top and bottom boots which clamp together over the lock body. In U.S. Pat. No. 3,848,440 a similar construction is disclosed with a lid snap fitted to a bottom casing. U.S. Pat. No. 3,858,419 discloses a similar arrangement, as do U.S. Pat. Nos. 4,224,813 and 3,983,725. U.S. Pat. Nos. 4,134,280, 4,286,445 and 4,218,902 are also similar.

In each instance, two or more portions of the protective casing must be pulled apart or a hinged trap door therein must be opened in order to permit access to the lock keyhole for operation of the lock. Such devices tend to become very brittle and stiff in use, so that their components become difficult to separate and reassemble and have a tendency to wear rapidly. This is particularly true when the ambient temperature is very low, as in the winter in northern climates. Moreover, such devices require complicated fabricating techniques and are relatively expensive.

Accordingly, it would be desireable to provide an improved lock and cover assembly wherein the cover is easy to install and to remove and is inexpensive, durable and efficient in all kinds of weather to fully protect the lock. Such cover should be capable of being made in a single molding operation or simple forming operation and be unitary in structure.

SUMMARY OF THE INVENTION

The improved lock and protective assembly of the present invention satisfies all the foregoing needs. The assembly is substantially as set forth in the Abstract above. Thus, it includes a lock, the body of which is wholly enclosed in a flexible, resilient, stretchable unitary casing up from which the lock hasp or shackle loop protrudes. The casing extends well below the lock and includes a bottom normally closed slit which is automatically openable merely by squeezing two opposed sides of the casing lower portion at opposite ends of the slit towards each other, thus permitting a key to be inserted through the slit into the keyhole. Upon removal of the key, the slit automatically relaxes to the closed position.

The casing is unitary and preferably is fabricated of polyurethane plastic elastomer in a molding operation. It can include top collars tightly gripping the hasp, and an optional dessicant can be disposed in a container in the casing. Thus, the casing is much simplier, more efficient and durable and less expensive than conventional lock covers. Further features of the invention are set forth in the following detailed description and accompanying drawings.

DRAWINGS

DETAILED DESCRIPTION

Figure 1:
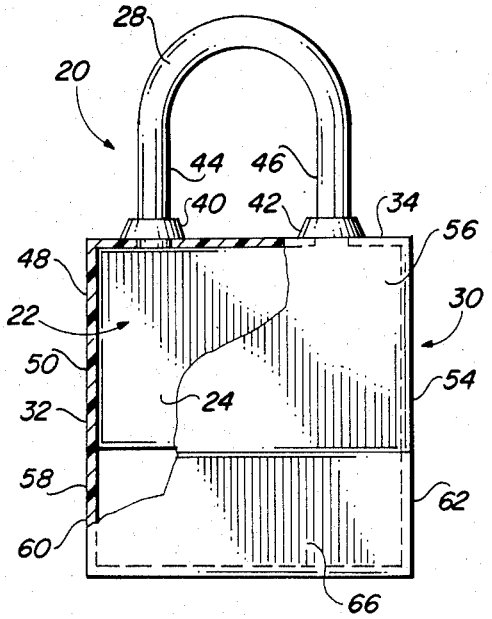
FIG. 1 is a schematic front elevation, partly broken away, of a first preferred embodiment of the improved lock and cover assembly of the present invention.
Figure 2:
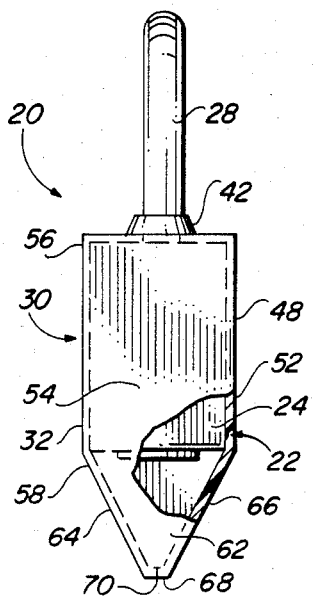
FIG. 2 is a schematic side elevation, partly broken away, of the assembly of FIG. 1.
Figure 3:
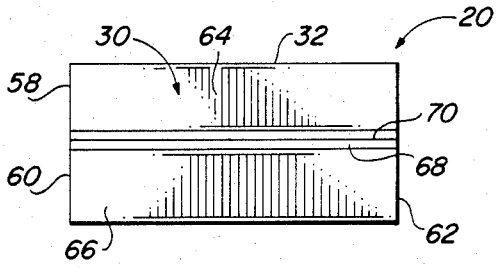
FIG. 3 is a schematic bottom plan view of the assembly of FIG. 1, shown with the bottom slit thereof in a relaxed closed condition.
Figure 4:
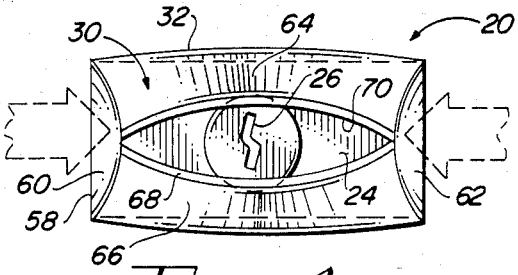
FIG. 4 is a schematic bottom plan view of the assembly of FIG. 1, shown with the bottom slit thereof open to expose the lock keyhole.
Figure 5:
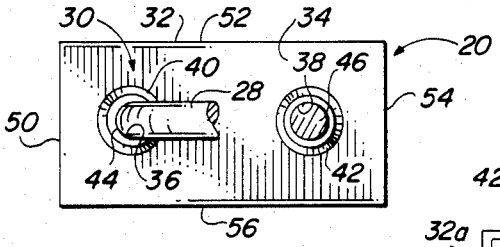
FIG. 5 is a schematic top plan view, partly broken away, of the assembly of FIG. 1.

FIGS. 1–5.

Now referring to FIGS. 1–5, a first preferred embodiment of the improved lock and cover assembly of the present invention is schematically depicted therein. Thus, assembly 20 is shown, which comprises a lock 22 having a lock body 24 with a bottom keyhole 26 (FIG. 4) and an inverted U-shaped two runged hasp 28 extending up from body 24.

Body 24 is completely enclosed in a cover 30 comprising a thin unitary casing 32 of flexible, resilient, stretchable material which retains its properties over a wide temperature range, including winter conditions in northern climates. Such material may be an elastomer of natural or synthetic rubber or plastic, for example, polyurethane plastic, and can be conveniently formed in a single simple molding or forming operation. Casing 32 is sufficiently stretchable so that it can be easily put in place over lock body 24, and adheres closely thereto and can as easily be removed therefrom. Casing 32 includes at its top 34 a spaced pair of openings 36 and 38 (FIG. 5) defined by a pair of collars 40 and 42 integral with top 34 and extending up therefrom to tightly and sealingly grip rungs 44 and 46 of hasp 28.

Casing 32 includes a rectangular upper portion 48 comprised of interconnected vertical sidewalls 50, 52, 54 and 56 joined to horizontal top 34, and closely adjacent to lock body 24, and a lower portion 58 joined thereto by depending opposed inverted, triangular vertical walls 60 and 62 and opposed walls 64 and 66; all of which extend well below lock body 24. Walls 64 and 66 are rectangular and converge downwardly to meet at an inverted apex at the bottom 68 of casing, defining therebetween a bottom-opening normally closed slit 70 (FIG. 3) aligned below keyhole 26.

Thus, casing 32 seals lock body 24 fully against the elements in all kinds of weather. When it is desired to operate lock 22, walls 60 and 62 are gripped between the thumb and fingers of one hand and are urged toward each other, flexing and bellying slit 70 open (FIG. 4) to fully expose keyhole 26 and thus enable a key held in the other hand to be inserted through slit 70 into keyhole 36 to operate lock 22. The key can then be withdrawn and finger pressure can be removed from walls 60 and 62, allowing slit 70 to relax to the closed position of FIG. 3.

The area around slit 70 is also sufficiently stretchable to permit introduction of lock 22 therethrough and into casing 32 of cover 30. Other portions of casing 32 are also stretchable to permit positioning of rings 44 and 46 through openings 36 and 38 to the installed position shown in FIGS. 1-5, and to permit easy removal of cover 30 from lock 22. Thus, assembly 20 is of improved design and function, offering efficient all-weather protection of lock 22 at low cost.

FIGS. 6-8.

Figure 8:
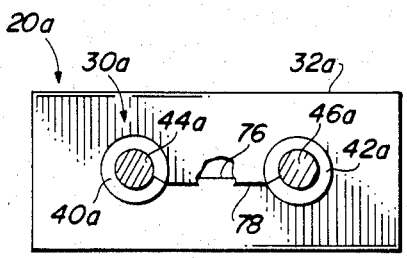
FIG. 8 is a schematic top plan view, partly broken away, of the assembly of FIG. 6.
Figure 6:
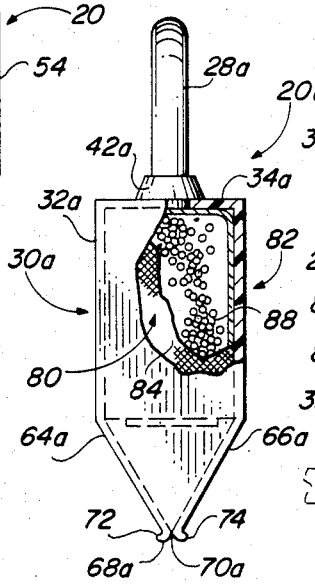
FIG. 6 is a schematic side elevation, partly broken away, of a second preferred embodiment of the improved assembly of the present invention.
Figure 7:
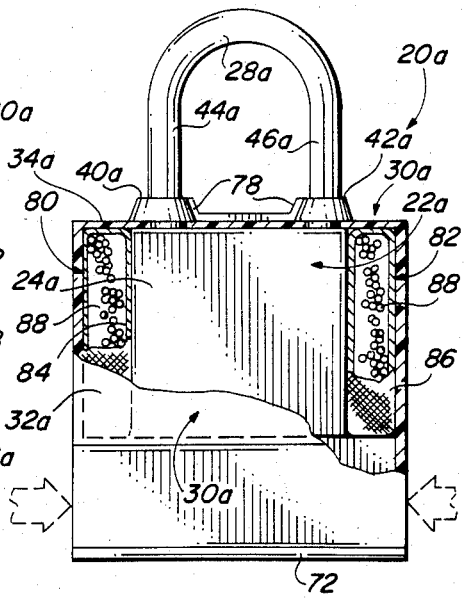
FIG. 7 is a schematic front elevation, partly broken away, of the assembly of FIG. 6.

A second preferred embodiment of the improved assembly of the present invention is schematically depicted in FIGS. 6-8. Thus, assembly 20*a* is shown. Components thereof similar to those of assembly 20 bear the same numerals, but are succeeded by the letter "a".

Assembly 20*a* is the same as assembly 20 except in three respects. Thus, slit 70*a* in bottom 68*a* of casing 32*a* of cover 30*a* is provided with a pair of downwardly and outwardly diverging curved lips 72 and 74 formed in walls 64*a* and 66*a*, respectively, to guide moisture away from slit 70*a*. Moreover, a slot 76 is disposed between and intersects collars 40*a* and 42*a* on top of 34*a* of cover 30*a* to allow lock body 24*a* to be easily installed through top 34*a* into casing 32*a* and to permit rungs 44*a* and 46*a* of hasp 28*a* to be easily installed in collars 40*a* and 42*a*. Slot 76 is protectively overlaid with a close-fitting flap 78 which extends to collars 40*a* and 42*a*, as shown in FIG. 8, to keep the elements from lock body 24.

Additional protective means are also provided in casing 32*a* at the sides thereof in the form of a pair of disposable containers 80 and 82 having vaporous walls 84 and 86, respectively, of cloth or the like, and containing a granular dessicant 88 such as calcium chloride or the like to trap any moisture which might reach lock body 24*a* in casing 32*a*. Accordingly, assembly 10*a* has the advantages of assembly 10, plus additional lock protective means.

FIGS. 9-11.

Figure 9:
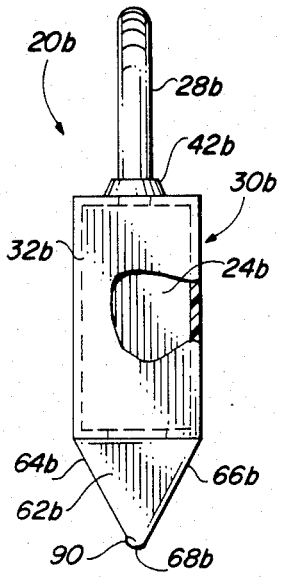
FIG. 9 is a schematic side elevation, partly broken away, of a third preferred embodiment of the improved assembly of the present invention.
Figure 11:
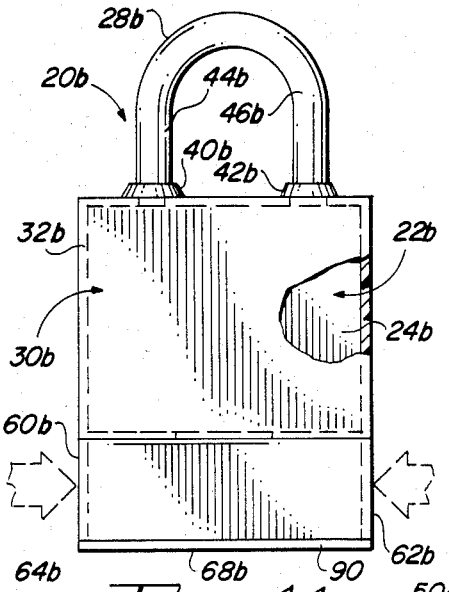
FIG. 11 is a schematic front elevation, partly broken away, of the assembly of FIG. 9.
Figure 10:
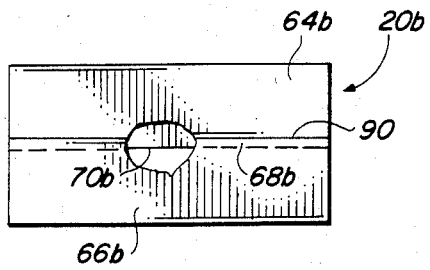
FIG. 10 is a schematic bottom plan view of the assembly of FIG. 9.
Figure 14:
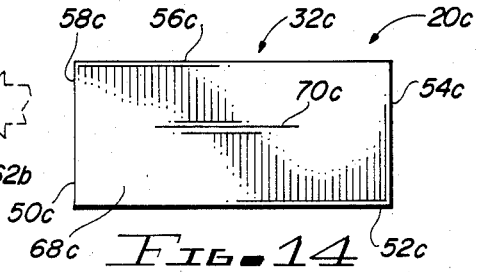
FIG. 14 is a schematic bottom plan view of the assembly of FIG. 12, shown with the bottom slit thereof in the closed relaxed condition; and, FIG. 15 is a schematic bottom plan view of the assembly of FIG. 12, shown with the bottom slit thereof in the flexed open position, exposing the lock keyhole.
Figure 12:
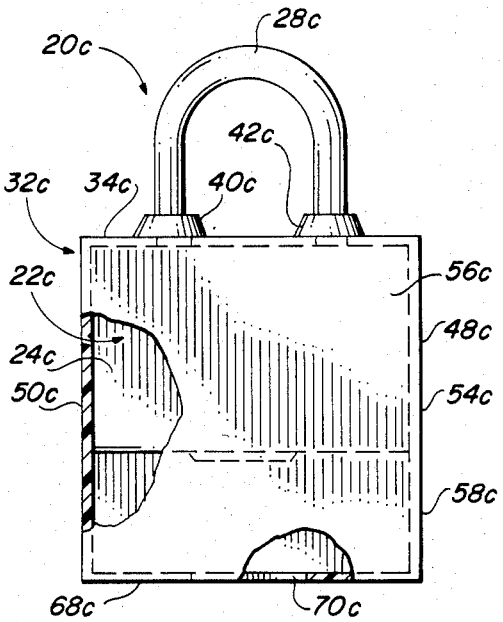
FIG. 12 is a schematic front elevation, partly broken away, of a fourth preferred embodiment of the improved assembly of the present invention.
Figure 13:
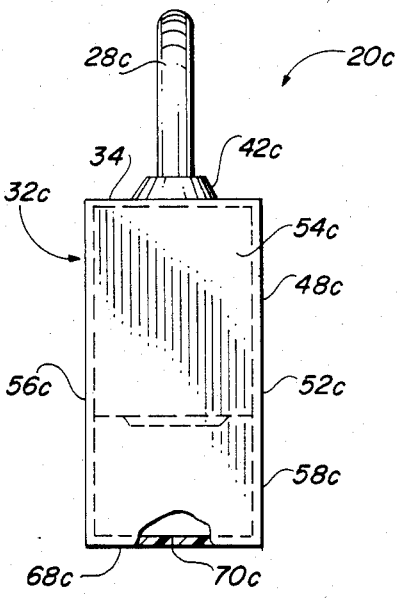
FIG. 13 is a schematic side elevation of the assembly of FIG. 12.
Figure 15:
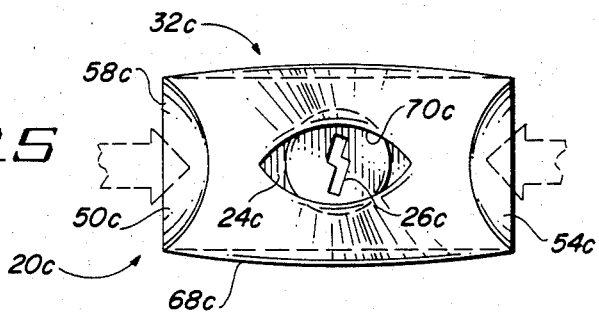

A third preferred embodiment of the improved assembly of the present invention is schematically depicted in FIGS. 9-11. Thus, assembly 20*b* is shown. Components thereof similar to those of assembly 20 or 20*a* bear the same numerals, but are succeeded by the letter "b". Assembly 20*b* is identical to assembly 20, including lock 22 with body 24 disposed in cover 30 comprising casing 32, except that slit 70*b* in bottom 68*b* of casing 32*b* is covered by a protective overlapping lip 90. Lip 90 is a forward extension of wall 66*b* over wall 64*b*. Slit 70*b* is opened by squeezing walls 60*b* and 62*b* towards each other, in order to expose the keyhole (not shown) of lock body 24*b* so that hasp 28*b* can be opened and reclosed. Thus, assembly 10*b* operates in the same manner as assembly 20, but with additional moisture protection means.

FIGS. 12-15.

A fourth preferred embodiment of the improved assembly of the present invention is schematically depicted in FIGS. 12-15. Thus, assembly 20*c* is shown. Components thereof similar to those of assembly 20 bear the same numerals, but are succeeded by the letter "c". Thus, assembly 20*c* is identical to assembly 20 except that the lower portion 58*c* of casing 32*c* is rectangular. Walls 50*c*, 52*c*, 54*c* and 56*c* of upper portion 48*c* of casing 32*c* merely continue perpendicularly down from horizontal top 34*c* to horizontal bottom 68*c*. Bottom 68*c* is well below body 24*c* of lock 22*c*, and bears a short slit 70*c* centered below keyhole 26*c*. Assembly includes hasp 28*c* extending up through collars 40*c* and 42*c*. When it is desired to open closed slit 70*c* from the relaxed position of FIG. 14 to the flexed position of FIG. 15 in order to expose keyhole 26*c*, the lower ends of walls 50*c* and 54*c* are squeezed toward each other (arrows of FIG. 15) until slit 70*c* bellies wide open. After lock 22*c* has been operated by a key inserted in keyhole 26*c* of lock body 24*c*, such key can be withdrawn. Then finger pressure can be removed from walls 50*c* and 56*c* and slit 70*c*, thereupon automatically closes to the sealed position of FIG. 14. Thus, assembly 20*c* thus is similar to assembly 20 in function and advantages.

Various other modifications, changes, alterations and additions can be made in the improved assembly, its components and parameters. All such changes, modifications, alterations and additions as are within the scope of the appended claims form part of the present invention.

What is claimed is:

1. An improved lock and protective cover assembly, said assembly comprising, in combination:

(a) a lock having i. a lock body with a bottom keyhole, and ii. an inverted U-shaped hasp connected to said main body and extending upwardly therefrom; and, (b) a flexible, resilient, stretchable unitary protective covering comprising a casing removably enclosing and sealing said lock body against the elements, said casing comprising, i. an upper portion disposed over the top and sides of said main lock body and defining top hasp openings sealingly gripping said hasp which extends upwardly therefrom, and ii. a lower portion integrally connected to said upper portion, extending below said lock body, comprising opposed sides and including a bottom defining a closed slit aligned below said keyhole and automatically openable by squeezing towards each other two of said opposed sides on opposite ends of said slit, to permit insertion of a key therethrough and into said keyhole to operate said lock.

2. The improved assembly of claim 1 wherein said casing lower portion is generally rectangular with said bottom being generally flat.

3. The improved assembly of claim 1 wherein there are four of said opposed sides of said casing lower portion, two of which are inverted triangular and the remaining two of said opposed sides being generally rectangular and downwardly converging to an inverted apex defining said slit.

4. The improved assembly of claim 1 wherein the area of said bottom defining said slit has legs which curve outwardly from said slit to divert moisture therefrom.

5. The improved assembly of claim 1 wherein the area of said bottom defining said slit includes a lip which extends over said slit to keep it sealed against moisture until said opening.

6. The improved assembly of claim 1 wherein said assembly includes accessory moisture protective means.

7. The improved assembly of claim 6 wherein said accessory moisture protective means includes at least one container containing a dessicant disposed within said casing.

8. The improved assembly of claim 6 wherein said accessory protective means includes a pair of spaced raised collars adapted to define said hasp-receiving openings and to tightly grip the rungs of said hasp.

9. The improved assembly of claim 8 wherein the top of said covering contains said collars and wherein said top defines a slot intersecting said collars, said top including a protective flap overlying said slot, whereby said covering can be readily opened to remove said lock from the top thereof.

10. The improved assembly of claim 1 wherein said covering comprises molded polyurethane elastomer.

11. A protective cover for a lock having a keyhole on the bottom thereof comprising, (a) a stretchable, unitary member adapted to cover the main body of said lock to prevent mositure from wetting said lock, (b) said unitary member including a lower portion extending downwardly from said main body, (c) said lower portion having a normally tightly closed slit therein which is in substantial alignment with said keyhole, (d) said lower portion including deformable means which causes said slit to open upon activation of said deformable means, (e) wherein said deformable means has four sides, two of which sides are of an inverted triangular shape and the remaining two of which sides are generally rectangular and downwardly converging to an inverted apex defining said slit, (f) wherein squeezing of the sides of said lower portion activates said deformable means to open up the slit to enable the insertion of a key through the slit and into the keyhole.

12. The cover of claim 11, wherein said unitary member includes an upper portion defining a plurality of openings adapted to sealingly grip a lock hasp.

13. The cover of claim 11 wherein said lower portion is generally rectangular and has a generally flat bottom.

14. The improved cover of claim 11 wherein said assembly cover includes moisture protective means.

15. The improved cover of claim 12 wherein said upper portion includes a pair of raised collars extending about and above said openings which are adapted to tightly but releasably grip a rungs of a lock hasp.

16. The cover of claim 12 wherein said upper portion has a portion thereof defining a slit intersecting said openings, whereby said cover can be readily opened to insert in or remove a lock from said cover.

17. The cover of claim 14 wherein said cover comprises molded polyurethane elastomer.

* * * * *